US005768715A

United States Patent [19]

Gregg, III et al.

[11] Patent Number: 5,768,715

[45] Date of Patent: Jun. 23, 1998

[54] PADDED HEAD PROTECTOR

[76] Inventors: Eugene Stuart Gregg, III, 20 Sally Port Rd., Hilton Head Island; Thomas Wood, 100 Forest Garden, Hilton Head, both of S.C. 29928

[21] Appl. No.: 816,593

[22] Filed: Mar. 13, 1997

Related U.S. Application Data

[63] Continuation of Ser. No. 431,415, May 1, 1995, abandoned.

[51] Int. Cl.[6] ..... A42B 3/00

[52] U.S. Cl. ..... 2/411; 2/421

[58] Field of Search ..... 2/410, 411, 413, 2/414, 421, 425, 2, 16, 20, 22

[56] References Cited

U.S. PATENT DOCUMENTS

| | | | |
|---|---|---|---|
| 3,555,561 | 1/1971 | Neis | 2/421 |
| 3,820,780 | 6/1974 | Tarbox | 2/425 |
| 3,916,446 | 11/1975 | Gooding | 2/425 |
| 4,062,067 | 12/1977 | Franzen | 2/410 |
| 4,646,367 | 3/1987 | El Hassen | 2/411 |
| 4,686,710 | 8/1987 | Marston et al. | 2/2 |
| 4,745,637 | 5/1988 | Steele et al. | 2/411 |
| 4,926,320 | 5/1990 | Aoki | 2/20 |
| 5,075,903 | 12/1991 | Richoux | 2/421 |
| 5,093,931 | 3/1992 | LeBerge et al. | 2/2 |

FOREIGN PATENT DOCUMENTS

| | | | |
|---|---|---|---|
| 539577 | 9/1941 | United Kingdom | 2/414 |
| 2220556 | 1/1990 | United Kingdom | 2/425 |

*Primary Examiner*—Michael A. Neas
*Attorney, Agent, or Firm*—H. Jay Spiegel

[57] ABSTRACT

A head protector includes two bands of material, one of which extends from beneath the chin to the top of the head, and the other of which extends from the forehead to the rear of the head. These bands are interconnected together to form a unitary device although, if desired, each band may be used individually. Each band includes padded portions which are preferably filled with a silastic gelin material which is located in areas designed to protect the eye sockets and eyes, zygoma, temporal bones and occiput which are the major bone complexes making up the lower sides and lower back of the skull. Additionally, the head protector protects the ear zygoma, the jaw and the top of the head vertex.

9 Claims, 5 Drawing Sheets

PADDED HEAD PROTECTOR

This application is a continuation of application Ser. No. 08/431,415 filed May 1, 1995, now abandoned

BACKGROUND OF THE INVENTION

The present invention relates to an improved padded head protector. A related application is U.S. Design patent application Ser. No. 29/032,276, filed on behalf of Applicants on Dec. 13, 1994, and seeking Design Patent coverage on the ornamental outward appearance of the protective head gear.

In the prior art, head protectors are known. However, Applicants are unaware of any such device including all of the features and aspects of the present invention.

The following prior art is known to Applicants:

U.S. Pat. No. 4,014,048 to Rappleyea

U.S. Pat. No. 4,095,294 to Winterbottom

U.S. Pat. No. 4,745,637 to Steele et al.

U.S. Pat. No. 5,129,106 to Liou.

Rappleyea discloses an inflation device which is designed to be used as or in association with protective head gear. The device includes upper and lower rings connected together by arcuate vertically extending ribs. The present invention differs from the teachings of Rappleyea as providing a device including two generally perpendicularly related bands which are filled with a resilient material.

Winterbottom teaches a head protector which includes a series of vertical and horizontal ribs integrated together into a single head gear which is inflatable. The present invention differs from the teachings of Winterbottom in that the present invention is not inflatable and includes two perpendicular connected bands each of which includes resilient material at specific locations thereon.

Steele et al. disclose a head protector including a plurality of tubular concentric rings connected together by vertical connectors with the rings being packed with a suitable yieldable packing material such as polyester packing. The present invention differs from the teachings of Steele et al. as contemplating two perpendicularly related bands of material which are filled at specific locations thereon with yieldable material.

Liou teaches an inflatable headband designed to be worn about the head of the user and including two spaced eye-bars designed to hold the user's eyeglasses. The present invention differs from the teachings of Liou as contemplating a non-inflatable device composed of two perpendicularly related bands of material filled with resilient shock absorbing material.

SUMMARY OF THE INVENTION

The present invention relates to an improved padded head protector. The present invention includes the following interrelated objects, aspects and features:

(A) The inventive improved padded head protector includes a vertically extending band of material which is designed to extend from beneath the chin of the user to the top of the head of the user. This vertically extending band of material includes a chin guard underlying the chin of the user and, at the location where it overlies the top of the head of the user, the vertically extending band of material has, enclosed therein, a resilient impact absorbing material such as, for example, silastic gelin material, a material containing polymeric silicones, having properties in common with rubber but more capable of withstanding wide temperature extremes.

(B) The inventive improved padded head protector further includes a horizontally extending band of material which includes two diametrically opposed loops which capture the vertically extending band of material to connect the two bands together. Of course, if desired, these loops could be located on the vertically extending band of material to capture the horizontally extending band of material.

(C) The horizontally extending band of material further includes two ends which are preferably interconnectable together through the use of a fastener such as, for example, hook and pile fastening means, better known by the Trademark "VELCRO".

(D) The horizontally extending band of material includes forward and lateral locations where impact absorbing material such as, for example, silastic gelin material is located.

(E) The inventive improved padded head protector has a design which is extremely advantageous as compared to prior art head protectors. It is specifically designed with only two bands of material as compared with other head protectors which include numerous bands of material so that it is not cumbersome and leaves most of the head exposed to the air, leaving the user cool and unencumbered. Furthermore, the areas where impact absorbing material is provided are specifically designated to be those locations where protection of the head of the user is essential, for example, around the eyes, at the crown of the head, adjacent the ears and for the jaw.

Accordingly, it is a first object of the present invention to provide an improved padded head protector.

It is a further object of the present invention to provide such a device including a vertically extending band of material coupled to a horizontally extending band of material.

It is a yet further object of the present invention to provide such a device wherein each of these bands of material includes pockets designed to hold gel packs.

It is a still further object of the present invention to provide the horizontally extending band of material with adjustable size so that it is able to be used with individuals with differing sized heads.

It is a still further object of the present invention to provide such a device wherein the vertically extending band of material includes some inherent resiliency allowing adjustability for differing head dimensions.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
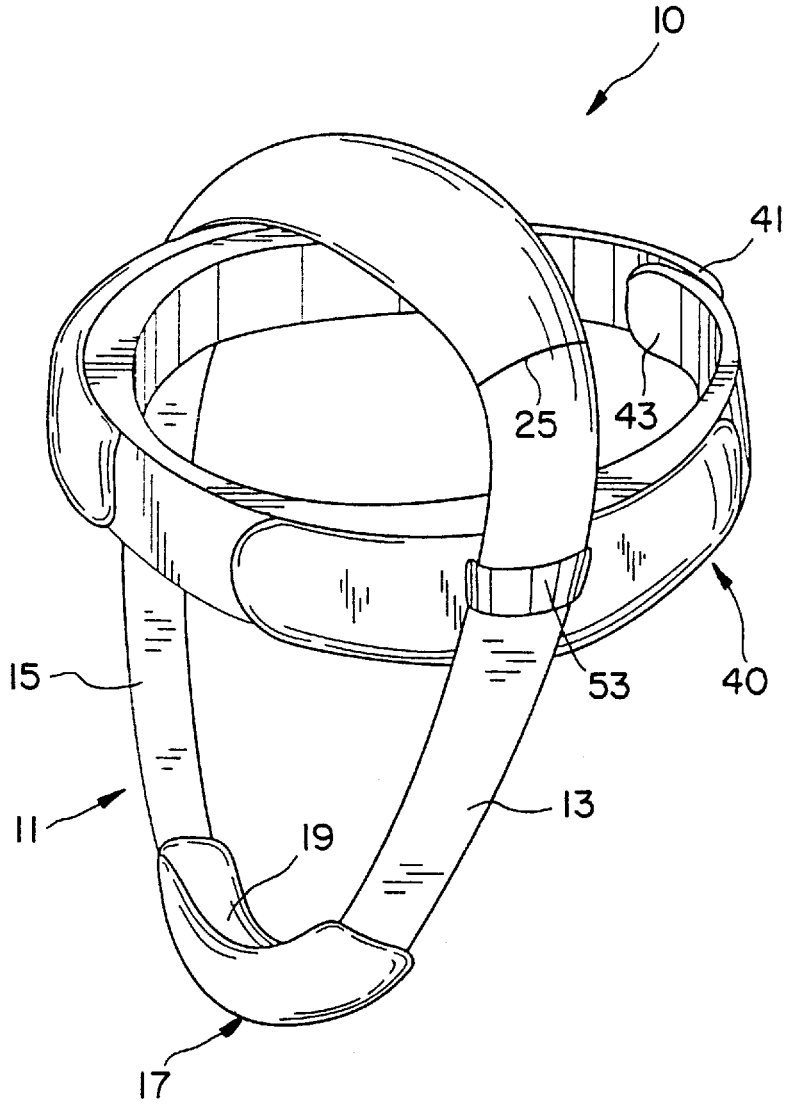
FIG. 1 shows a perspective view of the present invention.
Figure 2:
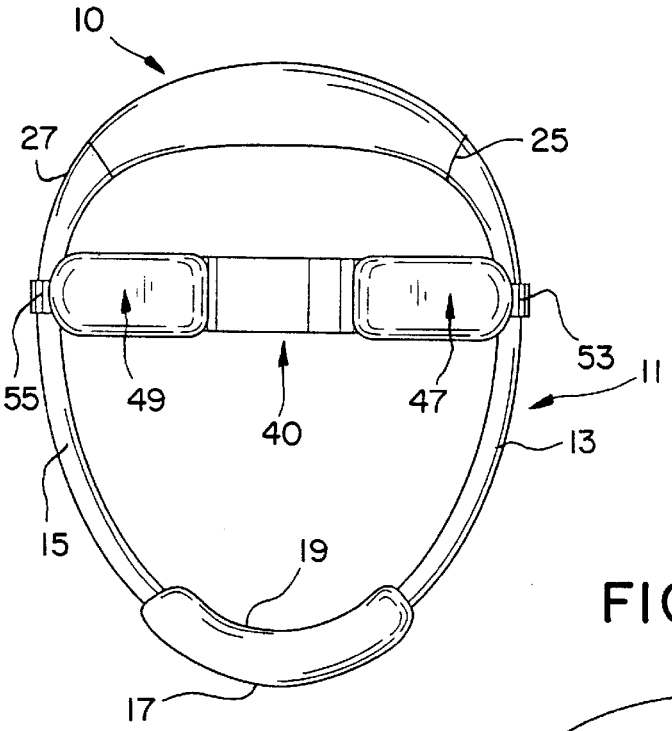
FIG. 2 shows a front view of the present invention.
Figure 3:
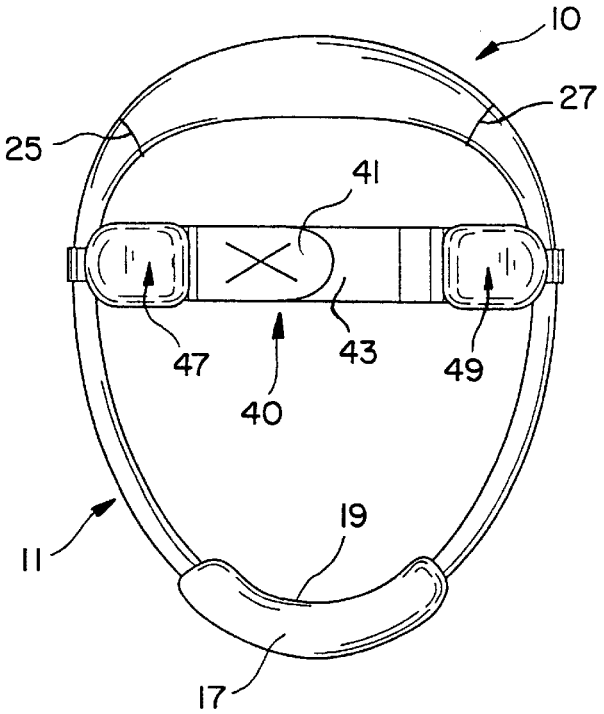
FIG. 3 shows a rear view of the present invention.

With reference to the figures, the inventive improved padded head protector is generally designated by the reference numeral 10 and is seen to include a vertically extending band of material 11 and a horizontally extending band of material 40. The vertically extending band of material 11 preferably includes portions 13 and 15 which are made of a resilient material such as, for example, those which are referred to by the Registered Trademarks "GORTEX" or "SPANDEX" to provide adjustability for heads of diverse dimensions. The band 11 further includes a chin or under the jaw cushion 17 having a recess 19 designed to receive the chin or the underside of the jaw of the user. This chin guard 17 may be made of any suitable resilient material.

Figure 6:
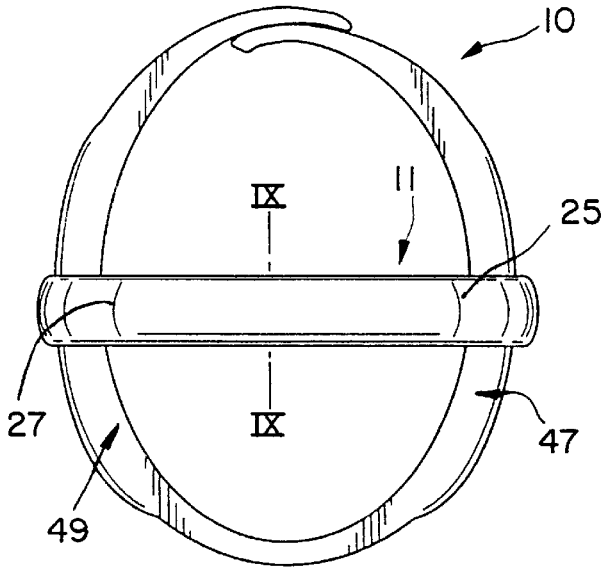
FIG. 6 shows a top view of the present invention.
Figure 7:
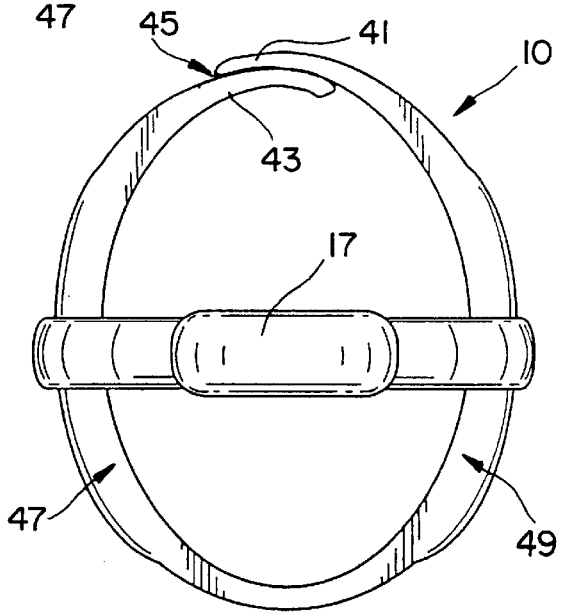
FIG. 7 shows a bottom view of the present invention.
Figure 9:
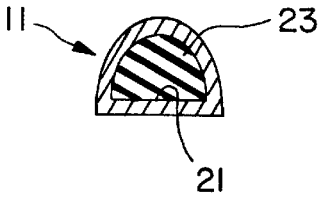
FIG. 9 shows a cross-sectional view along the line IX—IX of FIG. 6.

The upper portion of the band 11 includes an internal chamber 21 (FIG. 9) which contains, preferably, an impact absorbing silastic gelin material 23. The chamber 21 may have openings 25 and 27 (FIG. 6) which allow access to the chamber 21 to allow insertion and removal of the material 23. Any suitable access to the chamber 21 may be provided. As should be understood from FIG. 8, the material 23 is located in such a way that it protects the crown of the user's head.

With further reference to the figures, the horizontally extending band 40 is made of a strap-like material and includes, at a location corresponding to the rear of the head of the user, two ends 41 and 43 which may be interconnected together through the use of hook and pile fastening means 45 with the respective hook portion and pile portions thereof being installed in any suitable manner on the facing faces of the ends 41 and 43. Since the strap 40 is preferably made of a non-stretchable material, the ends 41 and 43 and the hook and pile fastening means 45 permit adjustment of the size of the band 40 to accommodate to differing sized heads.

With further reference to the figures, it is seen that the band 40 includes two regions 47 and 49 which include internal chambers similar to the internal chamber 21 of the band 11 and each of which contains an impact absorbing material such as, for example, silastic gelin material. Access to the internal chambers at the regions 47 and 49 may be similar to that of the access to the chamber 21 of the band 11, to-wit, openings such as the openings 25 and 27 to the chamber 21 of the band 11. As should best be understood from FIG. 8, the regions 47 and 49 are chosen to protect the ear zygoma (the arch just above the ear that joins the lower back part of the skull).

Figure 4:
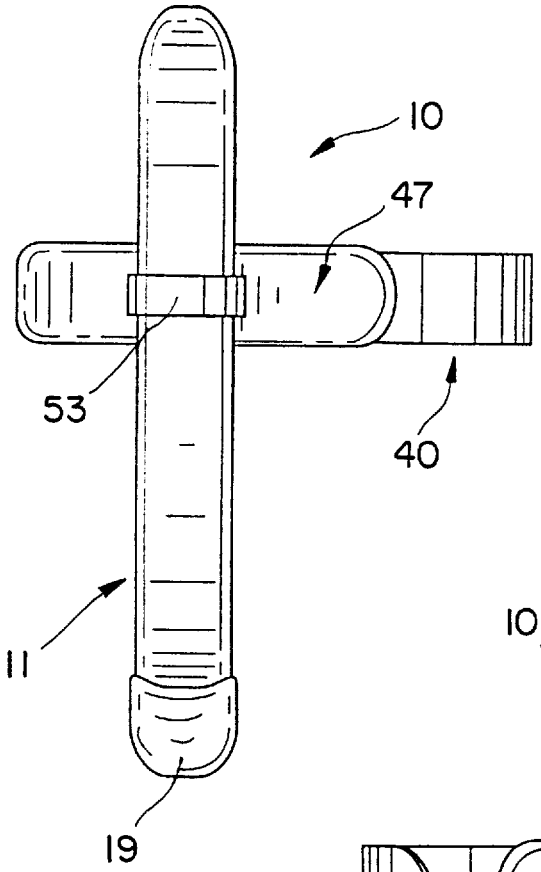
FIG. 4 shows a view from the left side of the present invention.
Figure 5:
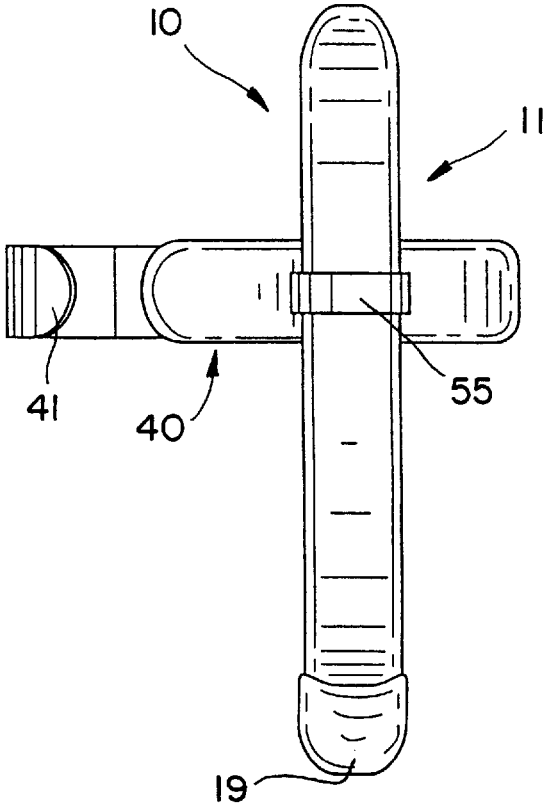
FIG. 5 shows a view from the right side of the present invention.

The band 40 has two diametrically opposed loops 53 and 55 which, as best seen in FIGS. 1, 4 and 5, retain the band 11 attached to the band 40. If desired, these loops 53 and 55 may include means (not shown) to allow them to be opened to permit easy separation of the band 11 from the band 40. For example, hook and pile fastening means, snaps, clips or other fastening means may be employed to allow opening of the loops 53 and 55 to allow removal of the band 11 from the band 40.

The inventive padded head protector is specifically designed to be lightweight and as uncumbersome as possible while functionally protecting important regions of the head of the user. Thus, the band 11 protects the chin or underside of the jaw of the user through the pad 19 while simultaneously protecting the crown of the head of the user through the use of the pad 23. Additionally, the pads contained within the regions 47 and 49 of the band 40 act to protect the ear zygoma as well as the eyes, temporal bones and occiput, that is, the major bone complexes making up the lower sides and lower back of the skull. The open nature of the inventive head protector prevents the user from feeling hot and confined when wearing the inventive device 10.

Figure 8:
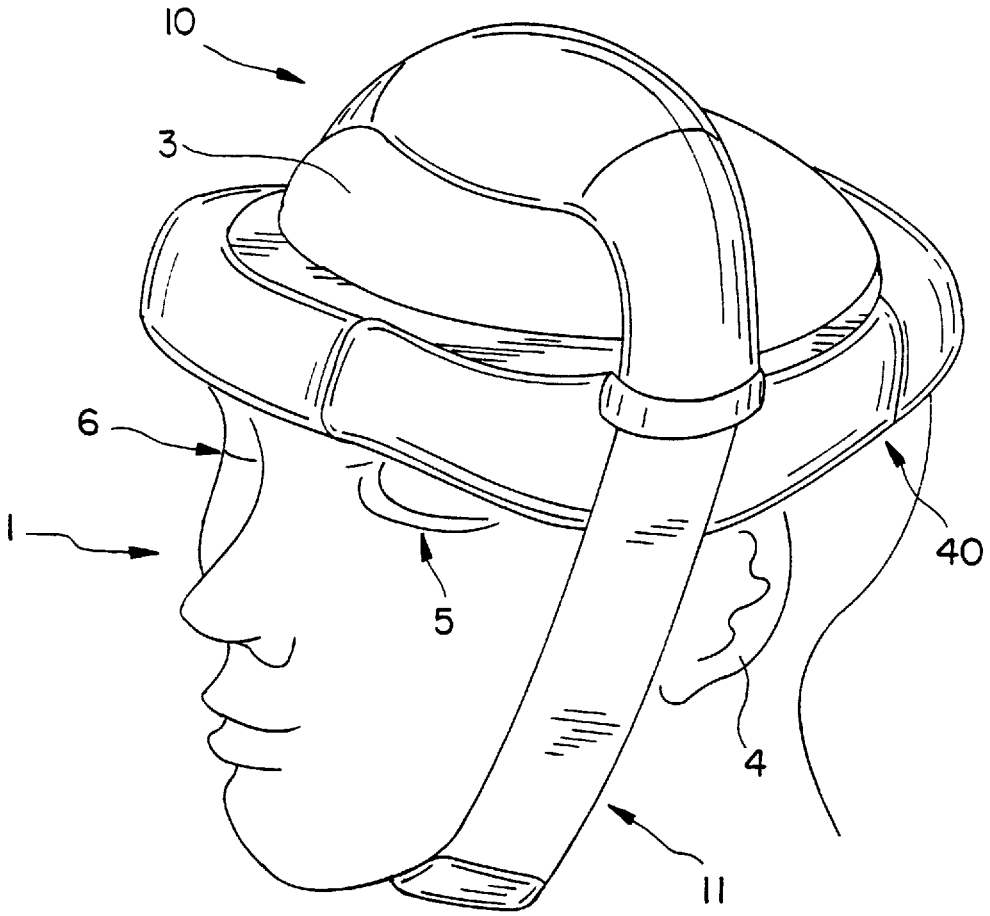
FIG. 8 shows a perspective view of the present invention, from the same perspective as shown in FIG. 1 but shown worn by a user.

As shown in FIG. 8, the user 1 has the crown of the skull 3, an ear 4 and eyes 5 and 6. FIG. 8 shows the manner in which the inventive device 10 protects these areas of the user's head as explained hereinabove.

The inventive head protector is easy to store, has a long useful life since it is resistant to tears and other damage, is adjustable in size to accommodate to users of differing sized heads and is easy to wash. It may be made in any desired color or colors and can be used with both bands of material 11, 40 or with each one separately.

In addition to being usable in playing contact sports, the inventive head protector may be used in construction work or in any endeavor in which head protection is necessary and/or desirable.

Accordingly, an invention has been described in terms of a preferred embodiment thereof which fulfills each and every one of the objects of the invention as set forth hereinabove and provides a new and useful improved padded head protector of great novelty and utility.

Of course, various changes, modifications and alterations in the teachings of the present invention may be contemplated by those skilled in the art without departing from the intended spirit and scope thereof. As such, it is intended that the present invention only be limited by the terms of the appended claims.

We claim:

1. A improved padded head protector, comprising:

a) a vertically extending band adapted to be placed around a user's head between a crown of a head thereof and either a chin thereof or under a jaw thereof, said vertically extending band being entirely made of a stretchable material to accomodate to user heads of differing dimensions;

b) a horizontally extending band connected to said vertically extending band and adapted to be placed around a user's head between a forehead thereof and a rear portion thereof;

c) each of said bands including a chamber having at least one opening and a resilient padding removably received in said chamber, said resilient padding comprising silastic gelin material.

2. The protector of claim 1, wherein said vertically extending band padding is located so as to protect a crown of a user's head.

3. The protector of claim 2, wherein said vertically extending band further includes a cushion opposite said padding positioned to cushion a user's chin or lower jaw.

4. The protector of claim 1, wherein said horizontally extending band padding is located in two diametrically opposed chambers thereon and is adapted to protect ears and eyes of a user.

5. The protector of claim 4, wherein said horizontally extending band includes two ends which may be adjustably interconnected together to adjust for user heads of differing dimensions.

6. The protector of claim 5, wherein said ends have hook and pile fastening means thereon.

7. The protector of claim 1, wherein said silastic gelin material is formed in shapes removably receivable in said chambers formed in said bands.

8. The protector of claim 1, wherein said bands are releasably attached together.

9. A padded head protector, comprising:

a) a vertically extending band adapted to be placed around a user's head between a crown of a head thereof and either a chin thereof or under a jaw thereof, said vertically extending band being entirely made of a stretchable material to accomodate to user heads of differing dimensions;

b) a horizontally extending band connected to said vertically extending band and adapted to be placed around a user's head between a forehead thereof and a rear portion thereof;

c) each of said bands including a chamber having at least one opening and a resilient padding removably received in said chamber.

* * * * *